US011149424B2

(12) United States Patent
Fitzgibbons

(10) Patent No.: US 11,149,424 B2
(45) Date of Patent: Oct. 19, 2021

(54) RESTROOM SYSTEM

(71) Applicant: Floyd Fitzgibbons, Fort Duchesne, UT (US)

(72) Inventor: Floyd Fitzgibbons, Fort Duchesne, UT (US)

( * ) Notice: Subject to any disclaimer, the term of this patent is extended or adjusted under 35 U.S.C. 154(b) by 84 days.

(21) Appl. No.: 16/861,762

(22) Filed: Apr. 29, 2020

(65) Prior Publication Data

US 2021/0047820 A1 Feb. 18, 2021

Related U.S. Application Data

(60) Provisional application No. 62/930,689, filed on Nov. 5, 2019, provisional application No. 62/885,658, filed on Aug. 12, 2019.

(51) Int. Cl.
*E03D 9/02* (2006.01)
*E03D 13/00* (2006.01)

(52) U.S. Cl.
CPC ..... *E03D 9/02* (2013.01); *E03D 13/007* (2013.01); *E03D 2009/026* (2013.01)

(58) Field of Classification Search
CPC ... E03D 1/003; E03D 5/003; E03D 2009/026; E03D 13/007; E03D 9/02; E03B 1/041; A47K 11/00
USPC ..... 4/638, 300.3
See application file for complete search history.

(56) References Cited

U.S. PATENT DOCUMENTS 2,860,348 A * 11/1958 McClenahan ..... E03C 1/01 4/665
3,383,710 A * 5/1968 Carmichael ..... E03D 9/031 4/300.3
3,869,732 A 3/1975 Garvey et al.
4,490,863 A * 1/1985 Pate ..... E03D 13/00 4/144.1
4,692,276 A 9/1987 Schramm
5,855,029 A * 1/1999 Flippen, Sr. ..... E03D 5/003 4/664
5,958,334 A * 9/1999 Haddon ..... A61L 9/04 422/5
9,909,293 B2 * 3/2018 Winter ..... E04H 1/1266
2006/0191064 A1 * 8/2006 Tan ..... E03D 9/03 4/300.3
2012/0186009 A1 * 7/2012 Lin ..... E03D 13/00 4/341

(Continued)

FOREIGN PATENT DOCUMENTS

CN 107035100 8/2017
KR 101918037 11/2018

*Primary Examiner* — Benjamin R Shaw
(74) *Attorney, Agent, or Firm* — Workman Nydegger

(57) ABSTRACT

A restroom system includes a sanitation station configured for hand washing and a waste station configured to receive a waste material from a user. A suds mixture is flowable through the sanitation station and the waste station and is configured for hand washing and to receive the waste material. The suds mixture includes a fluid layer and a suds layer positionable between the fluid layer and the user so that when the suds mixture receives the waste material the suds layer changes from an original shape to absorb energy and allow passage of the waste material through the suds layer into the fluid layer and then returns toward the original shape to form a protective barrier between the user and the waste material in the fluid layer.

20 Claims, 5 Drawing Sheets

(56) References Cited

U.S. PATENT DOCUMENTS

| | | | | |
|---|---|---|---|---|
| 2013/0055496 | A1* | 3/2013 | YYoshioka | E03D 1/33 4/324 |
| 2013/0305444 | A1* | 11/2013 | Boodaghians | E03D 9/05 4/323 |
| 2014/4002016 | | 1/2014 | Metcalf et al. | |
| 2016/0340882 | A1* | 11/2016 | Lee | E03B 1/041 |
| 2020/0190446 | A1* | 6/2020 | Sivik | B08B 9/00 |
| 2021/0032572 | A1* | 2/2021 | Aouad | C11D 1/10 |

* cited by examiner

RESTROOM SYSTEM

TECHNICAL FIELD

The disclosure pertains to a restroom system.

BACKGROUND

Restroom facilities, both public and private, are historically filthy places. For instance, users are commonly exposed to standing in other user's urine, unflushed toilets, dirty sinks, and dirty fixtures. In addition, male users are also often exposed to undesired "backsplash." When men urinate on a hard and small urinal, a combination of the urine and water regularly splashes back onto the user, the urinal, or onto the floor in the area of the urinal. This unfortunate phenomenon is commonly referred to as backsplash.

In addition to being unappealing, typical filth and unsanitary conditions in restroom facilities can be dangerous or even potentially deadly for users. For instance, when a person infected with a virus urinates, droplets of urine with the virus and/or other bodily fluids can fly into the air. Anyone within a specified distance of those droplets could be infected. In addition, it is understood fecal matter can spread infection from one person to another through direct contact. If an infected person uses a restroom and does not wash their hands, they could infect things and people they touch. A restroom user can also be infected by touching contaminated surfaces. For example, the user may touch a faucet, a toilet handle or countertop that is contaminated and then touch their nose, mouth, or eyes, resulting in an infection.

Restroom facilities are also known to be wasteful of water. Toilets and urinals can account for nearly one-third of a building's water consumption. Inefficient or poorly maintained toilet and urinal fixtures can be a major source of water waste.

There is thus a need for a restroom system that is more sanitary and water efficient.

BRIEF DESCRIPTION OF THE DRAWINGS

These and other features, aspects, and advantages of the present disclosure will become better understood regarding the following description, appended claims, and accompanying drawings.

SUMMARY

Figure 1:
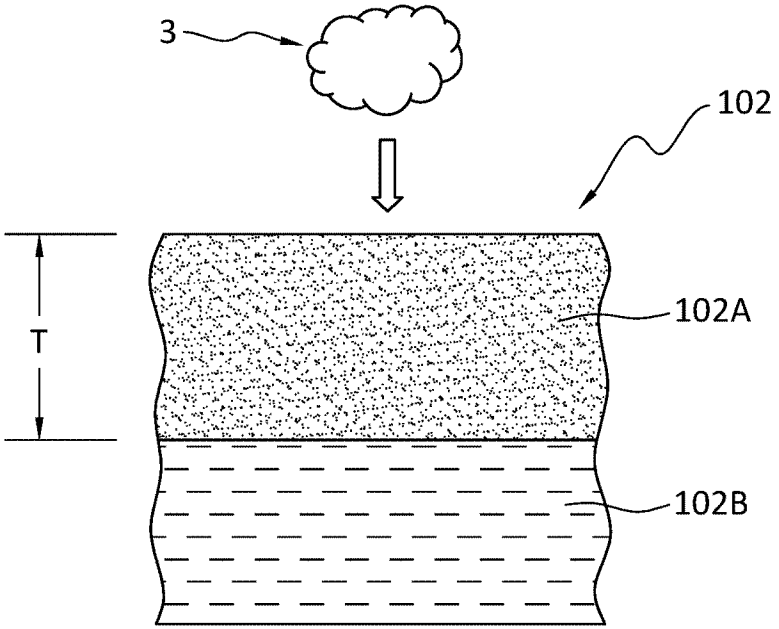
FIG. 1 is a schematic cross section view of a suds mixture according to an embodiment.

According to an embodiment, a restroom system includes a sanitation station configured for hand washing and a waste station configured to receive a waste material from a user. A suds mixture is flowable through the sanitation station and the waste station and is configured for hand washing and to receive the waste material. The suds mixture includes a fluid layer and a suds layer positionable between the fluid layer and the user so that when the suds mixture receives the waste material the suds layer changes from an original shape to dissipate energy and allow passage of the waste material through the suds layer into the fluid layer and then returns toward the original shape to form a protective barrier between the user and the waste material in the fluid layer.

This beneficially helps limit splatter generated by the waste material and captures and conceals the waste material below the suds layer, helping to control aesthetics and odors from the waste materials in the restroom system. It also advantageously helps limit the spread of disease and infections by protecting users from their own waste material and from waste materials of others.

According to a variation, the restroom system can be configured so that a same volume of the suds mixture can be used for hand washing, capturing the waste material, and transporting the waste material from the waste station. This beneficially can help reduce water usage and construction costs by eliminating the need of expensive fixtures. The also helps reduce the risk of flooding because fewer water sources are need for the restroom system to operate. The restroom system can also be arranged to distribute the suds mixture so that surfaces of the restroom system are self-cleaning, beneficially helping to prevent or reduce the likelihood of disease transmission.

DETAILED DESCRIPTION OF VARIOUS EMBODIMENTS

A better understanding of different embodiments of the disclosure may be had from the following description read with the accompanying drawings in which like reference characters refer to like elements.

While the disclosure is susceptible to various modifications and alternative constructions, certain illustrative embodiments are in the drawings and are described below. It should be understood, however, there is no intention to limit the disclosure to the specific embodiments disclosed, but on the contrary, the aim covers all modifications, alternative constructions, combinations, and equivalents falling within the spirit and scope of the disclosure.

It will be understood unless a term is expressly defined in this application to possess a described meaning, there is no intent to limit the meaning of such term, either expressly or indirectly, beyond its plain or ordinary meaning. Any element in a claim that does not explicitly state "means for" performing a specified function, or "step for" performing a specific function is not to be interpreted as a "means" or "step" clause as specified in 35 U.S.C. § 112(f).

Embodiments of the present disclosure include a restroom system incorporating a suds mixture configured to capture incoming waste material, limit the spread of disease and viruses, clean surfaces of the restroom system, and reduce the volume of water usage in the system at the same time. The suds mixture can be dispensed within the restroom system such that it has a suds layer having a thickness configured to eliminate splatter and capture and conceal the waste material and liquid located below the suds layer. "Suds" as used herein can comprise foam or a mass of bubbles that forms on the surface of any liquid or fluid. "Waste material" as used herein can comprise urine, fecal material, secondary washing material, bodily fluids, potentially infectious material, combinations thereof, or any other suitable waste material. "Potentially infectious material" as used herein can comprise bodily fluids that can spread infection from one person to another through direct contact.

According to a variation, the restroom system can be configured so that a same volume of the suds mixture can be used for hand washing, capture the waste materials, protect users and others from the waste materials, transport the waste materials, and control odors from the waste materials within the system. This beneficially can reduce water usage by the restroom system (e.g., up to about 80%) and can reduce construction costs significantly by eliminating the need of expensive fixtures. This also helps reduce the risk flooding within the restroom system because fewer water sources are needed for the restroom system to operate. The restroom system can also be configured to distribute the suds mixture so that surfaces of the restroom system are self-cleaning, beneficially helping to prevent or reduce the likelihood of disease transmission.

Figure 3:
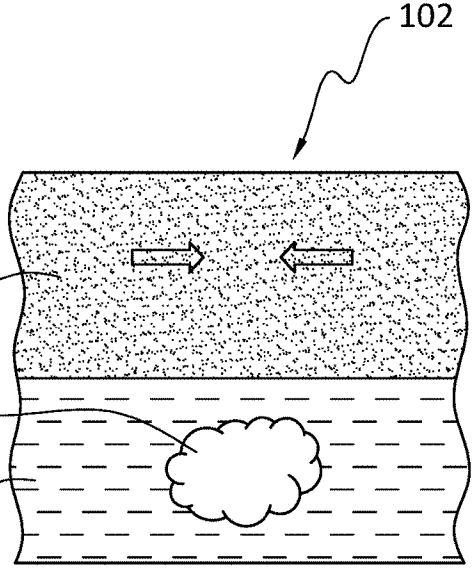
FIG. 3 is another schematic cross section view of the suds mixture of FIG. 1.
Figure 2:
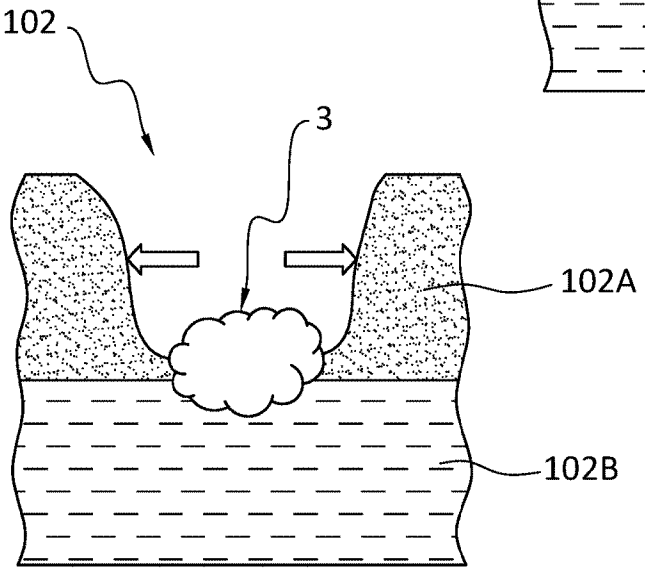
FIG. 2 is another schematic cross section view of the suds mixture of FIG. 1.

As shown in FIGS. 1-3, a suds mixture 102 according to an embodiment can comprise a suds layer 102A arranged to be located toward the user, and a fluid layer 102B underlying the suds layer 102A such that the suds layer 102A is located or positionable between the user and the fluid layer 102B. The suds layer 102A is arranged to allow passage of the one or more waste materials 3 through the suds layer 102A into the fluid layer 102B and then forms a protective barrier between the user and the one or more waste materials 3 in the fluid layer as discussed more herein.

The suds layer 102A can also be sized and configured to provide energy damping as a waste material 3 enters the suds mixture 102. It should be appreciated that the protective barrier formed by the suds layer 102A can be configured to provide odor control, disinfection, and capture of splatter from one or more waste materials 3. For instance, the suds layer 102A can define a thickness T configured to absorb energy from the one or more waste materials 3 and to reduce or eliminate splatter of the one or more waste materials 3. The thickness T can be between about 2 inches and about 6 inches (e.g., about 4 inches). It will be appreciated that the thickness T can be selected to vary the amount of energy the suds layer 102A absorbs and/or the amount of protection provided by the suds layer 102A. For instance, increasing the thickness T can dissipate more energy than a lesser thickness T and/or provided a greater protective barrier for capturing the one or more waste materials 3. In other embodiments, the suds layer 102A can prevent gases from escaping the fluid layer 102B, providing odor control.

The fluid layer 102B can be adapted to provide transport, disinfection, cover, and/or odor control. The fluid layer 102B can be adapted for transporting the one or more waste materials 3. The fluid layer 102B can comprise liquids, solids, and/or gases. It will be appreciated that the suds mixture 102 can comprise a solution, a suspension, or a colloid.

In use, as a user can direct the one or more waste materials 3 into the suds mixture 102. Before the one or more waste materials 3 contacts the suds mixture 102, the suds layer 102A can be in an original shape as shown in FIG. 1.

When the one or more waste materials 3 contacts or interfaces with the suds layer 102A, the suds layer 102A can disperse, deform, or change from the original shape in response to the contact with the one or more waste materials 3. This shape change can help absorb at least some of the energy from the one or more waste materials 3 and allow passage of the one or more waste materials 3 through the suds layer 102A as shown in FIG. 2. For instance, the suds layer 102A can spread or form an opening in the suds layer 102A upon contact with the moving one or more waste materials 3 to allow it pass into the fluid layer 102B and absorb energy from the one or more waste materials 3, which, in turn, helps dissipate splatter or splashing. As discussed above, the one or more waste materials 3 can comprise urine, fecal material, bodily fluids, potentially infectious materials, combinations thereof, or any other suitable waste material. In other embodiments, the one or more waste materials 3 can comprise used suds mixture from a sanitation station described below.

After moving through the suds layer 102A, the one or more waste materials 3 can enter and mix with the fluid layer 102B. As seen in FIG. 3, after or as the one or more waste materials 3 moves through the suds layers 102A into the fluid layer 102B, the suds layer 102A can change shape again or return toward the original shape (shown in FIG. 1), which, in turn, forms a protective barrier of the suds layer 102A between the user and the one or more waste materials 3. For example, the suds layer 102A can re-shape to completely cover the one or more waste materials 3 or fill openings formed in the suds layer 102A by the passage of the one or more waste materials 3. This beneficially can reduce odors and capture the one or more waste materials 3 and gases in the suds mixture 102 with the suds layer 102A and prevent splatter or backsplash.

It can also prevent droplets or splatter of the one or more waste materials 3 from rebounding or splashing off the fluid layer 102B in a direction toward the user. For instance, the suds layer 102A can provide an effective net or other structure that captures or blocks the lower energy droplets or splatter of the one or more waste materials 3 from traveling back toward the user. This advantageously can help prevent or limit the spread of infection and disease. It also helps maintain aesthetics and odor control within the restroom system. The same suds mixture 102 can also be used to wash the user's hands before it flows through the restroom system to provide the functionality described above.

According to a variation, the suds mixture 102 comprises solvents, antibacterial elements, and/or disinfectants such that the suds mixture can clean, disinfect, and/or sanitize surfaces contacting the suds mixture. In other embodiments, the suds mixture 102 comprises a cleanser, disinfectant, sanitizer, antibacterial agents, enzymes, fragrances, and coloring agents. The enzymes can be suitable for use in septic systems.

Figure 4:
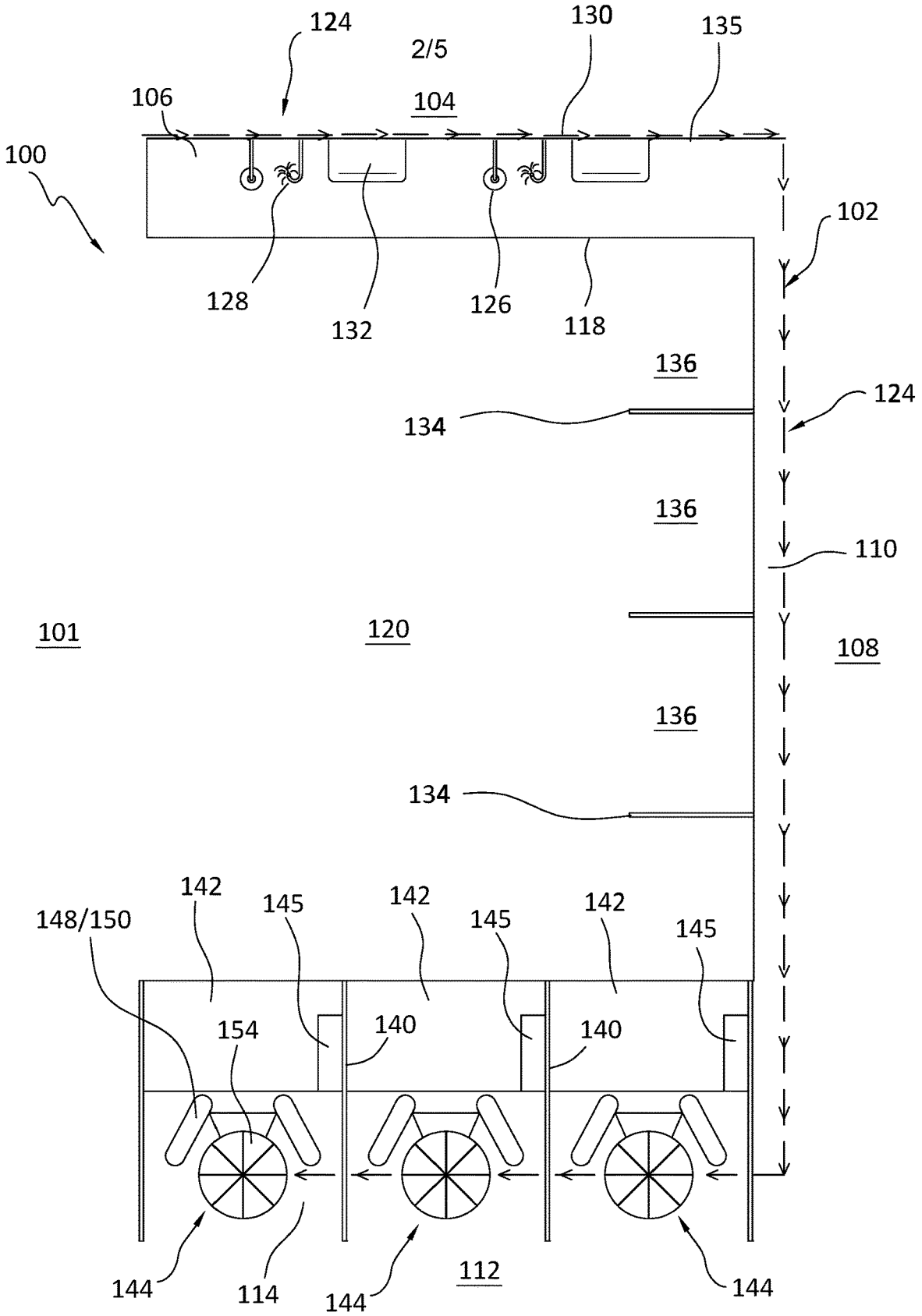
FIG. 4 is schematic view of a restroom system including a suds mixture according to an embodiment.

Referring now to FIG. 4, a restroom system 100 including the suds mixture 102 according to an embodiment is described. The suds mixture 102 can be similar to the suds mixture described above and can be configured to disinfect, sanitize, neutralize odors, protect the user and others from infection and disease, and/or transport waste materials through the restroom system 100. The restroom system 100 is described for use with a public restroom facility but it should be appreciated that the restroom system 100 can be configured for use in other types of facilities, including, but not limited to institutional, commercial, and private restrooms. Further, the same concepts and methods described may be similarly applied in other sanitary systems such as in processing systems, decontamination systems, and material or food preparation systems.

The restroom system 100 can include one or more sources for supplying the suds mixture 102 to a sanitation station 104. In an embodiment, the sanitation station 104 can be configured for hand washing and comprises a washing wall 106. From the sanitation station 104, the restroom system 100 conveys the suds mixture 102 to a first waste station 108 and then a second waste station 112. The first waste station 108 can comprise a urination wall 110, and the second waste station 112 can comprise a defecation wall 114. An access area 101 can provide a user access to any one of the sanitation stations 104, the first waste station 108, and/or the second waste station 112.

The restroom system 100 includes a conveyance system for transporting the suds mixture 102 through the restroom system 100. The suds mixture 102 can be flowable through at least the sanitation station 104 and the first waste station 108. For instance, the conveyance system can comprise a flow channel 118 that collects or catches the suds mixture 102 flowing down at least one of the washing wall 106 and the urination wall 110. The flow channel 118 can transport the suds mixture 102 collected from the washing wall 106 of the sanitation station 104 to the first waste station 108, and to the second waste station 112. It will be appreciated that the first waste station 108 may include one or more sources configured to supply an additional volume of the suds mixture 102 to the suds mixture 102 conveyed to the first waste station 108 through the flow channel 118 by the sanitation station 104.

Alternatively, the second waste station 112 can include one or more sources configured to supply an additional volume of the suds mixture 102 to the suds mixture 102 conveyed to the second waste station 112 through the flow channel 118 by the sanitation station 104 and/or the first waste station 108. At the second waste station 112, the suds mixture 102 exits the restroom system 100 through one or more outlets 122 fluidly connected to the flow channel 118. The suds mixture 102 beneficially can be reused and/or replenished from the sanitation station 104 through the first waste station 108, and from the first waste station 108 through the second waste station 112. The restroom system 100 can thus use a same suds mixture 102 or a same volume of the suds mixture 102 to both wash or clean the hands of a user and handle waste materials within the restroom system 100, beneficially reducing water usage, which, in turn, reduces operational costs and environmental consequences.

In an embodiment, the flow channel 118 has an open configuration that extends around a perimeter of a floor area 120 of the restroom system 100 and/or at a base of each the washing wall 106, the urination wall 110, and the defecation wall 114. It will be appreciated that the flow channel 118 can have any suitable configuration. For instance, the flow channel 118 can be a sloped floor gutter in the floor area 120 defining a low or minimal slope toward the one or more outlets 122. In an embodiment, the flow channel 118 can have a length extending along the washing wall 106, the urination wall 110, and the defecation wall 114, a width of about 2 feet, and a depth of about 4 inches. In other embodiments, the dimensions of the flow channel 118 can be larger or smaller.

In an embodiment, the one or more sources of the suds mixture 102 comprise one or more supply lines 124 located along one or more of the washing wall 106, the urination wall 110, and/or the defecation wall 114 above the flow channel 118. The one or more supply lines 124 carry and supply the suds mixture 102 and are fluidly connected to a plurality of dispensers or first emitters 126 arranged to supply the suds mixture 102 to at least one of the washing wall 106 and the urination wall 110 and into the flow channel 118. The one or more supply lines 124 can also carry and supply water and be fluidly connected to a plurality of second emitters 128 arranged to supply water to at least the washing wall 106 and into the flow channel 118.

The one or more supply lines 124 can extend continuously or discontinuously along the washing wall 106, the urination wall 110, and/or the defecation wall 114. The one or more supply lines 124 can be located along the outside or inside of the washing wall 106, the urination wall 110, and/or the defecation wall 114. As discussed herein, the supply of the suds mixture 102 and/or water to one more of the washing wall 106, the urination wall 110, and/or the defecation wall 114 beneficially provides cleaning, flushing, recycling, collecting and conveying of waste materials to the one or more outlets 122.

Figure 5:
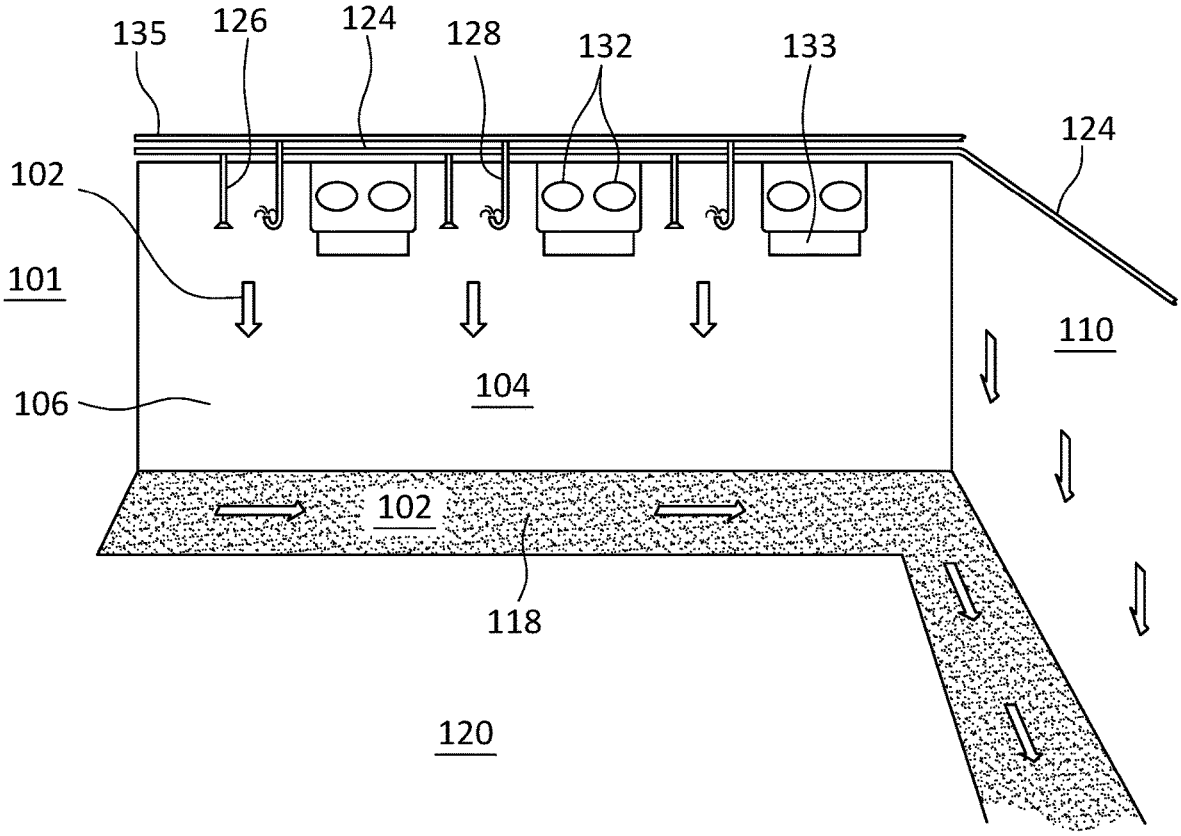
FIG. 5 is a partial schematic view of a restroom system according to an embodiment.

Referring now to FIG. 5, the sanitation station 104 can comprise the washing wall 106, the one or more supply lines 124, the first emitters 126, the second emitters 128, and the at least one vacuum unit 132. Along the washing wall 106, the one or more supply lines 124 can include a first supply line 130 arranged to carry the suds mixture 102. The suds mixture 102 can be discharged from the first supply line 130 through one or more of the first emitters 126 so that a user can wash their hands using the suds mixture 102 as it exits the first emitters 126 and/or runs down the washing wall 106.

It will be appreciated the suds mixture 102 can be discharged from the first supply line 130 without the user having to physically contact the washing wall 106 or the first emitters 126. For instance, the first emitters 126 can be operatively connected to sensors or motion sensors that direct the first emitters 126 to release the suds mixture 102 when the user's hand are positioned near or under the first emitters 126. This beneficially reduces the likelihood of disease transmission by reducing the likelihood of surface contact between the user and the restroom system 100. In an embodiment, the suds mixture 102 includes skin friendly antibacterial and cleaning components, safely and effectively cleaning the user's hands.

In an embodiment, the first emitters 126 can comprise small protrusions extending from the washing wall 106, sprayers, or any other suitable emitter. In other embodiments, the first emitters 126 can comprise apertures in the first supply line 130. The flow channel 118 is positioned and configured so that excess suds and the suds mixture 102 falls into the flow channel 118 and flows toward the first waste station 108.

According to a variation, the one or more supply lines 124 can include a second supply line 135 extending along the washing wall 106 and arranged to carry water. The water can be discharged from the second supply line 135 through the second emitters 128 so that a user can rinse or wet their hands. In an embodiment, the second emitters 128 can be arranged to release a small amount of low-pressure water in a fountain-like or bubble fashion, reducing the likelihood of splashing. The second emitters 128 can comprise small protrusions, apertures, fountains, spickets, sprayers, or any other suitable emitter. Optionally, similar to the first emitters 126, the second emitters 128 can be operatively connected to one or more sensors or motion sensors that direct the second emitters 128 to dispense water when the user's hand are positioned under the second emitters 128. The flow channel 118 is positioned and configured so that excess water falls into the flow channel 118 and flows toward the first waste station 108.

According to a variation, the sanitation station 104 can include at least one vacuum unit 132 configured to dry the user's hands via negative pressure or a vacuum, which, in turn, draws or pulls water and other materials off the hands and into the at least one vacuum unit 132. This advantageously eliminates water splattering in different directions and creating a mess as in prior art hand cleaning systems. Moreover, it provides a sanitary, environmentally friendly manner to clean hands. In an embodiment, the at least one vacuum unit 132 includes an intake protection unit 133 including a screen arranged in the vacuum inlet and a catch basin for collecting items blocked by the intake protection unit 133. This can help the reduce the likelihood of the user losing personal items and/or damaging the at least one vacuum unit 132.

The sanitation station 104 thus allows a user to easily clean their hands as excess water and suds mixture 102 from the sanitation station 104 falls into the flow channel 118, which, in turn, carries the suds mixture 102 through the first waste station 108 and the second waste station 112. The user can also do without any surface contact with the washing wall 106. This beneficially enhances removal of waste and hand washing using less water and in a more environmentally friendly and sanitary manner.

Figure 6:
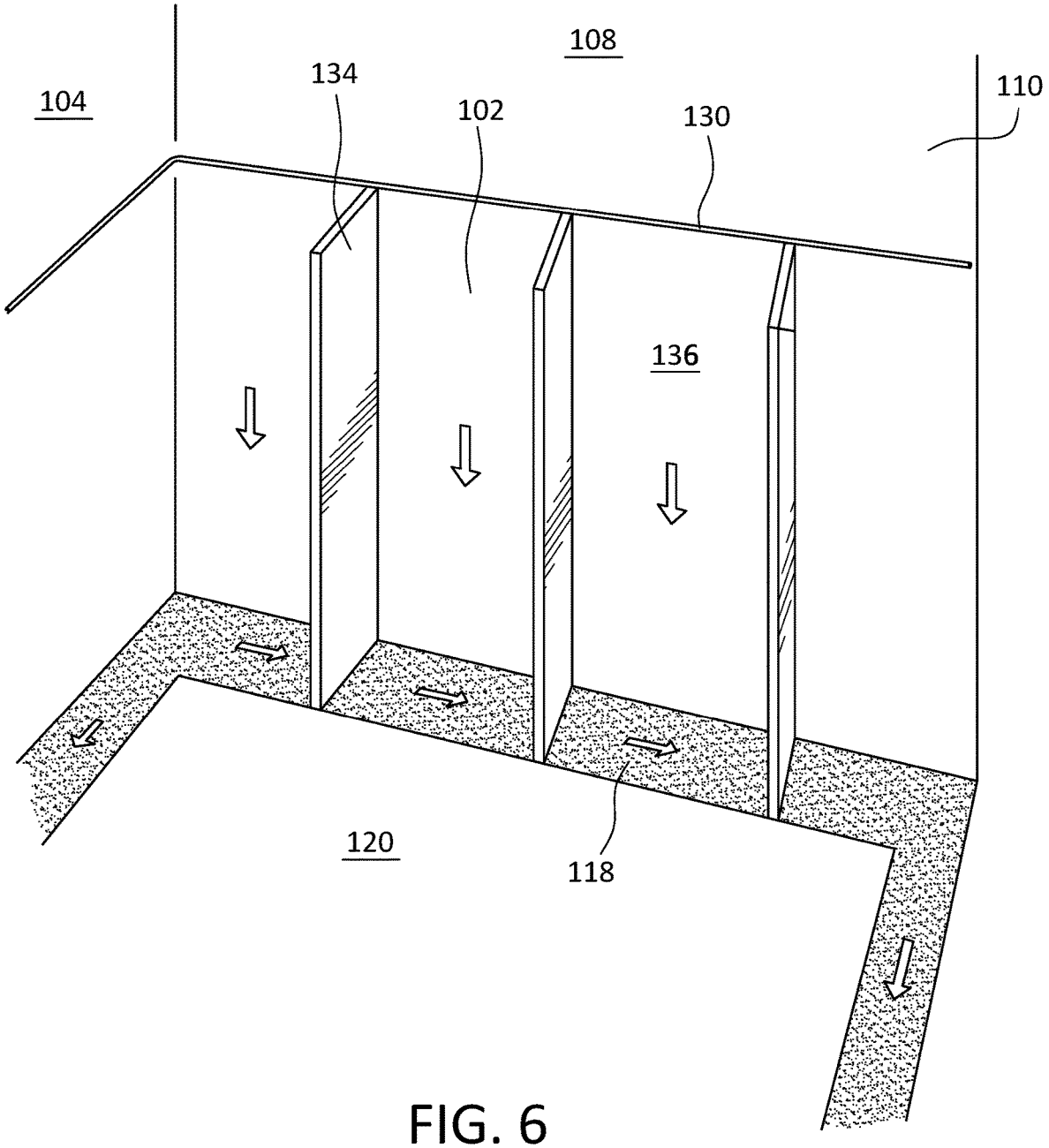
FIG. 6 is a partial schematic view of a restroom system according to an embodiment.

Referring to FIG. 6, the first waste station 108 can comprise a urination station including a plurality of partitions 134 separating the urination wall 110 into a plurality of urination stalls 136 configured to provide privacy. The first supply line 130 carrying the suds mixture 102 can run across the urination wall 110 over or above the partitions 134. One or more users, with privacy created by the partitions 134, can stand and urinate onto the suds mixture 102 running down the urination wall 110 from the first supply line 130 into the flow channel 118 and/or directly into the suds mixture 102 flowing through the flow channel 118. Preferably, the first supply line 130 can supply the suds mixture 102 without any physical contact between the user and the urination wall 110, helping to prevent the spread of disease and infection through surface to surface contact.

It will be appreciated that while the users are described as being in a standing position while urinating, in other embodiments, the first waste station 108 can be modified to accommodate users, such as female users, urinating in a sitting or squatting position. For example, the first waste station 108 can include a plurality of suspended seat pads positioned over the flow channel 118 carrying the suds mixture 102.

As seen in FIG. 6, the suds mixture 102 flows through the flow channel 118 from the sanitation station 104 to the first waste station 108. In use, a user can urinate into the suds mixture 102, which in turn, causes the suds layer 102A to spread or open upon contact with the waste material comprising urine. The urine then passes through the thickness T of the suds layer 102A such that it can mix with and be transported away by the fluid layer 102B. As the urine moves through the suds layer 102A, the properties of the suds layer 102A can close suds layer 102A around or above the mixture of urine and the fluid layer 102B, capturing the urine in the suds mixture 102 and preventing splatter. The suds layer 102A also provides a protective barrier for the user from germs and other potentially infectious materials. The suds layer 102A also can conceal the urine, maintaining the aesthetics of the suds mixture 102. From the first waste station 108, the suds mixture 102 carrying the urine can flow to the second waste station 112 through the flow channel 118.

Figure 7:
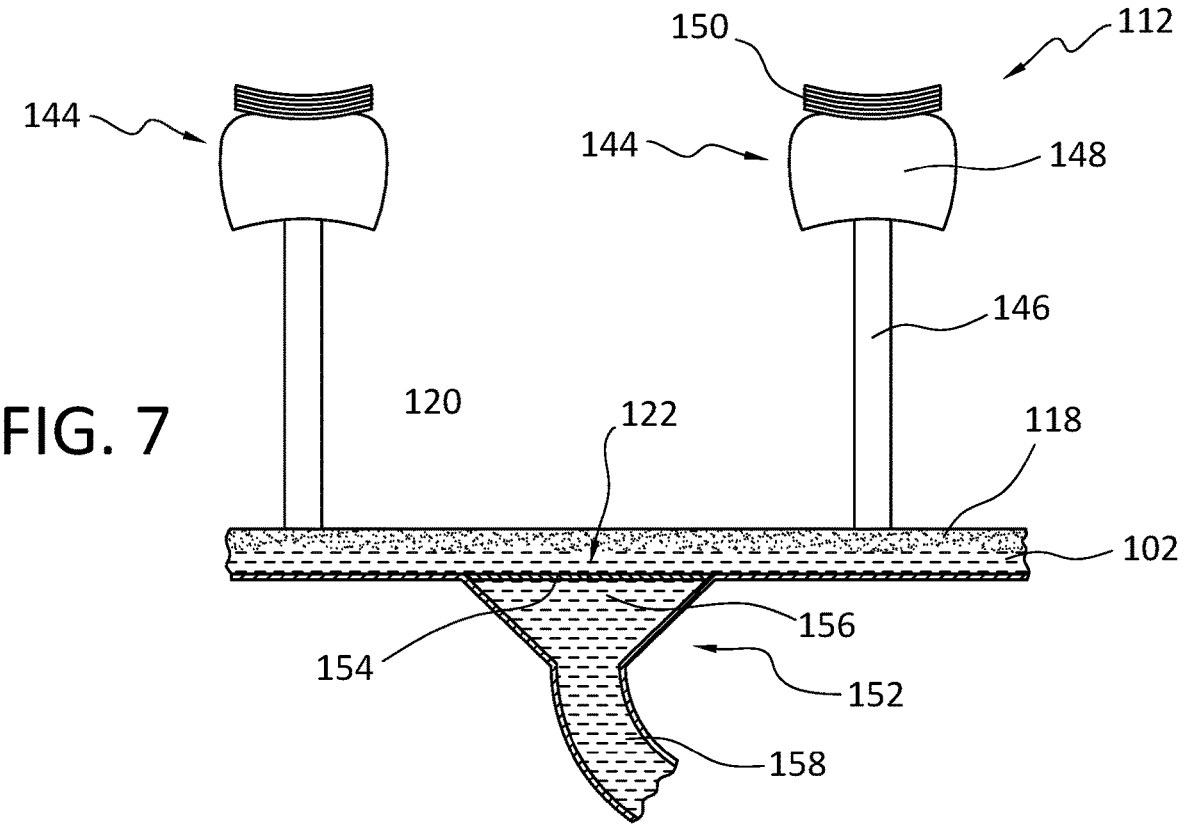
FIG. 7 is a schematic view of a waste station according to an embodiment.

Referring to FIG. 7, the second waste station 112 can include a plurality of partitions 140 (shown in FIG. 4) forming a plurality of restroom stalls 142 (shown in FIG. 4) configured to allow a user to maintain a seated position in order to urinate or defecate into the suds mixture 102. In an embodiment, one or more of the restroom stalls 142 includes a toilet unit 144 positioned at or near the flow channel 118 running through the restroom stalls 142, and optionally toilet paper holders 145 (shown in FIG. 4). In an embodiment, the toilet unit 144 includes a support member 146 connected to the floor area 120, and a seat pad 148 positioned on the support member 146. The seat pad 148 defines an opening over the flow channel 118 carrying the suds mixture 102. Optionally, sanitary paper sheets 150 can be removably and disposably affixed to the upper side of the seat pad 148, reducing the likelihood of germ or material transfer between different users.

In use, a user can sit on the toilet unit 144 and urinate or defecate into the suds mixture 102 being carried in the flow channel 118. As discussed above, the suds mixture 102 reduces splashing, controls odors, cleans the flow channel 118, protects the user, and transports the waste material away. For instance, the suds mixture 102 can carry the waste material through the flow channel 118 to the one or more outlets 122 located along the flow channel 118. As discussed above, the suds mixture 102 flowing through the second waste station 112 may already be carrying urine from the first waste station 108, and/or water from the sanitation station 104. As such, the restroom system 100 can use a same volume of suds mixture 102 for hand washing, urination, and defecation, substantially reducing water usage.

It will be appreciated that the one or more outlets 122 can be in fluid communication with a sewer pipe 158 or drain pipe located below the flow channel 118. In an embodiment, the one or more outlets 122 include a valve system 152 that controls fluid flow into the sewer pipe 158. For instance, the valve system 152 can comprise a control valve 154 and a collector 156 connected to the sewer pipe 158. The collector 156 can have a funnel shape configured to receive and swiftly evacuate waste material, and toilet paper into the sewer pipe 158. In an embodiment, the properties of the suds layer 102A allows the suds layer 102A to quickly fill in any gaps or openings in the suds layer 102A generated by the passage of the waste material, which, in turn, provides a protective layer between the user and the waste material, reducing odor from the waste material, covering the waste material, and helping clean the restroom system 100.

The control valve 154 can be operable to permit and prevent fluid flow into the collector 156. According to a variation, the control valve 154 can be controlled by motion or mass sensors. In other embodiments, the control valve 154 can be operated by a pedal system or lever system. The control valve 154 can be a flapper valve or any other suitable type of valve. The second waste station 112 can thus be operational without the user having to touch any buttons or handles with their hands, which, in turn, reduces the likelihood of disease transmission.

Figure 8:
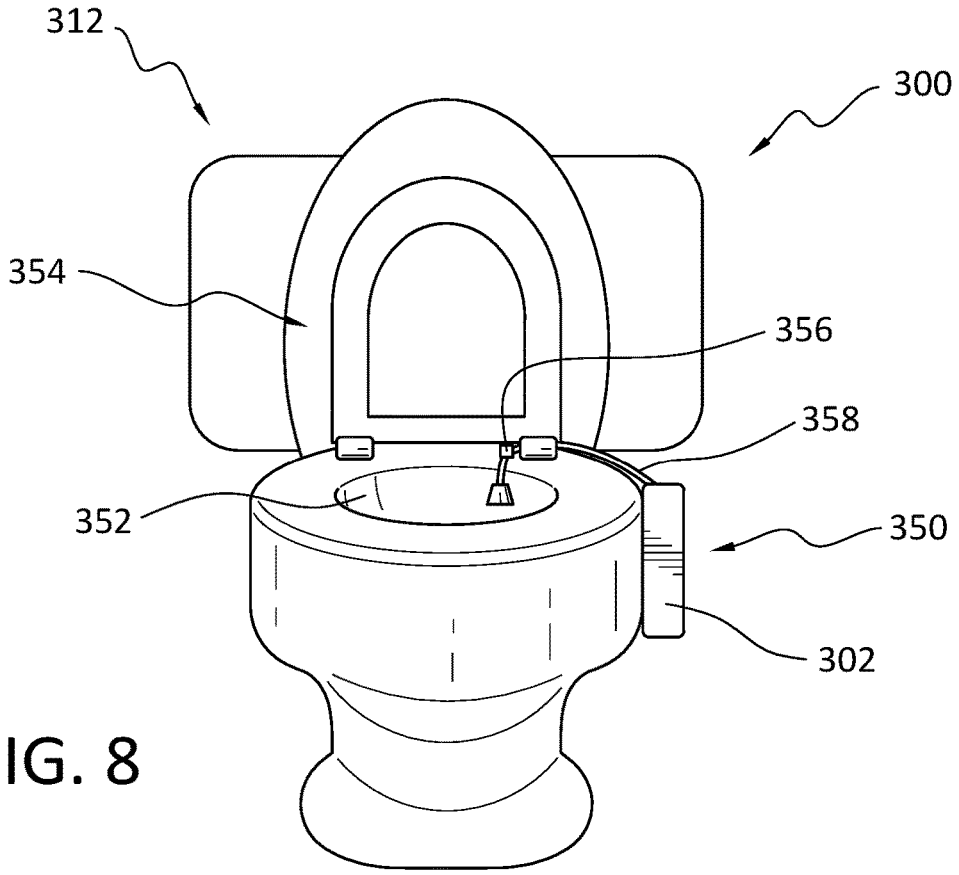
FIG. 8 is a schematic view of a restroom system according to another embodiment.

FIG. 8 illustrates a restroom system 300 according to another embodiment including a conventional toilet tank system or residential toilet 312 and a supply of a suds mixture 302. For instance, a dispenser 350 carrying a supply of the suds mixture 302 can be configured to supply or dispense the suds mixture 302 onto the water surface and/or inside of a toilet bowl 352. Like other embodiments, the suds mixture 302 can help eliminate or limit toilet bowl rings, odors, backsplash and reduce the constant soiling of the toilet. The dispenser 350 can be low profile and/or can have any suitable shape.

In an embodiment, the dispenser 350 can be located on the outside of the toilet bowl 352 and fluidly connected to the inside of the toilet bowl 352. The toilet bowl 352 can be retrofitted with the dispenser 350 so that no other equipment on the residential toilet needs to be replaced or modified. According to a variation, the dispenser 350 is configured to activate or supply the suds mixture 302 to the toilet water surface based on movement and/or position of the toilet seat 354 or lid. For instance, the dispenser 350 can dispense suds mixture 302 unto the water surface upon lifting of the toilet seat 354 or lid and/or lowering the toilet set 354 or lid. The dispenser 350 may be operatively coupled to a sensing device 356 that provides an actuating signal to the dispenser 350 based on movement and/or position of the toilet seat 354 or lid.

According to a variation, a supply line 358 or tube is fluidly connected to the dispenser 350 and adapted to discharge the suds mixture 302 into the toilet bowl 352. The supply line 358 or tube can be connected to the toilet bowl 352 and routed toward the inside of the toilet bowl 352 in any suitable manner. For instance, the supply line 358 or tube can be connected to the toilet bowl 352 via one or more clip members at or near the hinges. In other embodiments, the dispenser 350 can be integrated on the inside of the toilet bowl 352 or can comprise a hand-held spray bottle. In other embodiments, the first waste station and/or sanitation station may be omitted from the system.

Restroom system embodiments of the present disclosure thus beneficially includes a suds mixture that can capture incoming waste material, limit the spread of disease and infections, clean surfaces of the restroom system, and reduce the volume of water usage in the restroom system at the same time. Moreover, the restroom system is configured to supply and transport the suds mixture with minimal or limited physical contact with a user, further protecting the user and reducing the likelihood of disease transmission.

The various aspects and embodiments disclosed herein are for purposes of illustration and are not intended to be limiting. Additionally, the words "including," "having," and variants thereof (e.g., "includes" and "has") as used herein, including the claims, shall be open-ended and have the same meaning as the word "comprising" and variants thereof (e.g., "comprise" and "comprises").

The invention claimed is:

1. A restroom system comprising:

a sanitation station configured for hand washing;

a waste station configured to receive a waste material from a user; and a suds mixture flowable through the sanitation station and the waste station and configured for hand washing and to receive the waste material, the suds mixture including a fluid layer and a suds layer positionable between the fluid layer and the user so that when the suds mixture receives the waste material the suds layer changes from an original shape to absorb energy and allow passage of the waste material through the suds layer into the fluid layer and then returns toward the original shape to form a protective barrier between the user and the waste material in the fluid layer.

2. The restroom system of claim 1, wherein the protective barrier is configured to completely cover the waste material in the fluid layer and to capture splatter from the waste material traveling toward the user from the fluid layer.

3. The restroom system of claim 1, wherein the restroom system supplies at least some of the suds mixture to the waste station from a washing wall of the sanitation station.

4. The restroom system of claim 1, wherein a same volume of the suds mixture is configured to wash one or more hands of the user, capture the waste material, controls orders from the waste material, and transport the waste material away from the waste station.

5. The restroom system of claim 1, wherein the suds mixture is configured to sanitize the waste material and the waste station.

6. The restroom system of claim 1, wherein the waste station comprises a urination station including a urination wall.

7. The restroom system of claim 6, wherein the sanitation station includes a washing wall, and a flow channel fluidly connects the washing wall and the urination wall, the flow channel arranged to carry a same volume of the suds mixture from the sanitation station to the waste station.

8. The restroom system of claim 7, further comprising a second waste station including at least one toilet unit, the flow channel arranged to carry the same volume of the suds mixture from the sanitation station to the waste station to the second waste station.

9. The restroom system of claim 7, wherein the suds mixture is configured to clean one or more surfaces contacting the suds mixture.

10. The restroom system of claim 9, wherein the one or more surfaces comprise the washing wall, the urination wall, and the flow channel.

11. The restroom system of claim 7, further comprising a supply line configured to supply the suds mixture to the washing wall and the urination wall above the flow channel.

12. The restroom system of claim 7, wherein the sanitation station includes at least one vacuum configured to dry one or more hands of the user by pulling a vacuum.

13. The restroom system of claim 7, wherein the waste station is configured so that the user urinates into the suds mixture running down the urination wall and through the flow channel in the waste station.

14. The restroom system of claim 1, wherein the waste station comprises a toilet unit.

15. The restroom system of claim 1, wherein the suds layer defines a thickness of between about 2 inches and about 6 inches.

16. A restroom system comprising:

a sanitation station including a washing wall;

a first waste station including a urination wall;

a second waste station including at least one toilet unit;

a suds mixture configured to flow down at least the washing wall and the urination wall; and a flow channel fluidly connecting the washing wall, the urination wall, and the at least one toilet unit, the flow channel arranged to carry the suds mixture from the sanitation station to the first waste station, and from the first waste station to the second waste station.

17. The restroom system of claim 16, wherein a same volume of the suds mixture is configured to wash hands of a user, capture a waste material from the user, and transport the waste material to at least one of the first waste station and the second waste station.

18. The restroom system of claim 17, further comprising a supply line configured to supply the same volume of suds mixture to the washing wall.

19. The restroom system of claim 18, wherein the flow channel transports the same volume of suds mixture from the sanitation station to the first waste station, and from the first waste station to the second waste station.

20. A restroom system comprising:

a sanitation station including a washing wall;

a first waste station including a urination wall;

a second waste station including at least one toilet unit;

a suds mixture configured to flow down at least the washing wall and the urination wall, the suds mixture including a fluid layer and a suds layer positionable between the fluid layer and a user so that when the suds mixture receives a waste material from the user the suds layer changes from an original shape to dissipate energy and allow passage of the waste material through the suds layer into the fluid layer and then returns toward the original shape to form a protective barrier between the user and the waste material in the fluid layer; and a flow channel fluidly connecting the washing wall, the urination wall, and the at least one toilet unit, the flow channel arranged to carry the suds mixture from the sanitation station to the first waste station, and from the first waste station to the second waste station.

* * * * *